US005844768A

United States Patent [19]

Yamanaka

[11] Patent Number: 5,844,768

[45] Date of Patent: Dec. 1, 1998

[54] SCOROTRON TYPE CHARGING DEVICE WITH ELEVATION SUPPRESSION DEVICE FOR A GRID PLATE

[75] Inventor: Toshio Yamanaka, Osaka, Japan

[73] Assignee: Sharp Kabushiki Kaisha, Osaka, Japan

[21] Appl. No.: 527,534

[22] Filed: Sep. 13, 1995

[30] Foreign Application Priority Data

Sep. 14, 1994 [JP] Japan ..... 6-219856

[51] Int. Cl.[6] ..... G03G 15/02

[52] U.S. Cl. ..... 361/229; 361/225; 355/171

[58] Field of Search ..... 361/229, 225; 355/225; 399/171

[56] References Cited

U.S. PATENT DOCUMENTS 4,408,865 10/1983 Camis et al. ..... 361/225
5,079,668 1/1992 Maeshima ..... 361/229
5,206,784 4/1993 Kimiwada et al. ..... 361/229

FOREIGN PATENT DOCUMENTS 61-99164 6/1986 Japan .
62-103053 7/1987 Japan .
62-26760 7/1987 Japan .

*Primary Examiner*—Jeffrey A. Griffin
*Assistant Examiner*—Thuy-Trang N. Huynh

[57] ABSTRACT

A charging device which can suppress elevation of the grid plate under tension is obtained. In the charging device, elevation suppression means is provided at the opposing ends of the regulation member for regulating the distance between the surface of the photoreceptor and the grid plate. By the elevation suppression means, the breadthwise outer edge portions of the plate are forced to bend up toward the photoreceptor and the central portion thereof deflects in the opposite direction toward the regulation member and is brought into close contact therewith, so that grid plate is kept flat on a level with the regulation member.

11 Claims, 16 Drawing Sheets

SCOROTRON TYPE CHARGING DEVICE WITH ELEVATION SUPPRESSION DEVICE FOR A GRID PLATE

BACKGROUND OF THE INVENTION

1. Field of the Invention

The present invention relates to charging devices of a scorotoron type for charging a surface of a photoreceptor in an electrophotographic copying apparatus, a laser printer, and the like.

2. Description of the Background Art

In a conventional charging device of a scorotron type, tension is applied to a grid plate to keep flat a surface thereof so that a distance between the surface of a photoreceptor and the grid plate can be uniform. Japanese Utility Model Publication No. 62-26760 discloses a charging device in which tension is applied to a grid plate by means of a spring, and this method is commonly known. FIG. 16 shows the charging device disclosed in Japanese Utility Model Publication No. 62-26760. Referring to FIG. 16, a support 2 is provided for supporting a shield plate 1 from each side thereof. A corona wire 3 is held under tension by a wire height regulation member 4. A grid plate 5 is attached close to a photoreceptor 6, and a movable control plate 7 for pulling grid plate 5 is provided. A spring 8 is also provided for moving movable control plate 7 outward through a detachable axis 9, and a flange 10 is attached photoreceptor 6.

Grid plate 5 of this discharging device has one end hooked to a hook 7*a* of movable control plate 7 and the other end engaging with a fixed hook of the support on the other side, which is not shown. Movable control plate 7 is urged outward by the force of spring 8 and tension is applied to grid plate 5, thereby keeping the surface of the grid plate 5 flat.

A charging device which utilizes other means to apply tension to a grid plate is shown in FIGS. 17–19. In this device, a grid holder 12*a* on one side for holding a grid plate 11 is fixed while a grid holder 12*b* on the other side is movable. By loosening an adjusting screw 13, grid holder 12*b* is moved outward in a longitudinal direction to apply tension to grid plate 11. In FIGS. 17–19, the charging device includes front and rear housings 14 and 15, a pair of opposing side plates 16*a* and 16*b*, a needle-like corona discharger 17, a holder 18 for holding corona discharger 17, an electrode plate 19 for applying a voltage to corona discharger 17, and a regulation portion 20 brought into contact with grid plate 11 for keeping constant the distance from the photoreceptor. Front and rear housings 14 and 15, side plates 16*a* and 16*b* are integrally assembled by screws and form a main body of the charging device, and corona discharger 17 is attached to holder 18, which are installed in the main body of the device. The movable grid holder 12*b* is mounted in rear housing 14 so that it can move in the directions indicated by the arrows A and B in FIG. 19 by means of adjusting screw 13, while grid holder 12*a* is fixed to rear housing 15.

In other words, grid plate 11 has one end held by the fixed grid holder 12*a* and the other end held by a hook 21 of the movable grid holder 12*b*. By loosening adjusting screw 13, the movable grid holder 12*b* moves and adjusts tension to grid plate 11, and then the movable grid holder 12*b* is completely fixed by a fixing screw 22.

Although it is true that tension is applied stably to grid plate 5 by spring 8 in the charging device shown in FIG. 16, the device has a complicated structure and is large. In most cases, a charging device must be assembled in a considerably small space. Therefore, a large device with a complicated structure will give a big problem in terms of design and assembly. In particular, since the distance between grid plate 5 and the surface of the photoreceptor is set to be approximately 1 mm, a projection such as movable control plate 7 shown in FIG. 16 projecting toward photoreceptor 6 in the proximity thereof will be an obstacle and may dangerously contact photoreceptor 6.

Although a charging device with screws has no projections in the proximity of the photoreceptor and can be made compact and simplified, tension applied to grid plate 11 must be adjusted because it is applied by adjusting screw 13, which is troublesome.

More specifically, if too much tension is applied for its adjustment, a grid plate, especially one having a width exceeding 20 mm, deforms with its central portion in the direction of its width elevated toward the photoreceptor as shown in FIG. 20. As a result, grid plate 11 is not brought into contact with regulation portion 20, making it impossible to keep constant the distance from the photoreceptor. This may lead to a problem that grid plate 11 is brought too close to the photoreceptor, thereby generating leakage.

This up-rise of grid plate 11 occurs as follows. When tension is applied, the breadthwise central portion of grid plate 11 stretches outward and its breadthwise outer edge portion is stressed toward the center. When this stress overcomes the rigidity of grid plate 11, the plate is elevated. Thus, it has been extremely difficult to adjust tension without causing deflection and elevation of grid plate 11. In order to suppress such elevation, only the necessary openings, such as a central mesh structure 23 and holes 24 for engaging with both grid holders 12*a* and 12*b* of grid plate 11, are provided so as to ensure the rigidity of grid plate 11 itself.

However, if the rigidity of grid plate 11 in the direction of its width is ensured, the rigidity thereof in the longitudinal direction is also undesirably ensured. This results in another problem that the ends of grid plate 11 in the longitudinal direction are elevated from regulation portions 20 as shown in FIG. 22. Thus, regulation portion 20 no longer serves to regulate the height of grid plate 11.

SUMMARY OF THE INVENTION

One object of the present invention is to provide a charging device which can suppress elevation of a grid plate when tension is applied.

Another object of the present invention is to achieve simplification of the tension applying structure of the grid plate in the charging device.

A charging device in accordance with one aspect of the present invention includes a grid plate positioned with a predetermined distance from a surface of a photoreceptor for stabilizing electrostatic charges from a corona discharger, a support for holding the grid plate with its both ends pulled in the longitudinal direction, and a regulation member brought into contact with a rear surface of both ends of the grid plate for regulating the distance between the surface of the photoreceptor and the grid plate. Elevation suppression means is provided for bringing the grid plate into close contact with the regulation member when tension is applied to the grid plate. The elevation suppression means can be a projection formed on both :breadthwise ends of the regulation member. An auxiliary regulation member may be provided extending outward in the longitudinal direction from both breadthwise ends of the regulation member. In order to weaken the rigidity of the grid plate, the plate is provided with a plurality of openings in the breadthwise direction at a contact portion abutting the regulation member of each end. One of the supports is fixed and holding one end of the grid plate, while the other support is rotatable, holding and pulling the other end of the grid plate in the longitudinal direction.

In this charging device, the attaching operation of the grid plate begins with hooking one end of the grid plate to said one support. Thereafter, the other end of the grid plate is hooked to the other support, which is then rotated outward in the longitudinal direction. As the other support is rotated, tension is gradually applied to the grid plate in the longitudinal direction. When the other support stops rotation, appropriate tension is applied to the grid plate.

At this time, the breadthwise outer edge of the grid plate is forced to bend up toward the photoreceptor by a projection provided at the regulation member. The breadthwise central portion of the grid plate deforms toward the regulation member and is brought into contact therewith, so that the plate is kept flat at a level with the regulation member.

The lengthwise bending strength of the grid plate is weakened by the openings of the contact portion, and the plate is held in a state where a portion thereof between the support and the regulation member is bent at both ends, so that the contact portion of the plate is brought into close contact with the regulation member.

At the auxiliary regulation member provided extending from the regulation member, the breadthwise outer edge portion of the grid plate between the support and the regulation member is forced to bend upward, and the breadthwise central portion of the grid plate located therebetween is bent downward, away from the photoreceptor. As a result, the contact portion of the grid plate becomes ideally flat and contacts the regulation member.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 2:
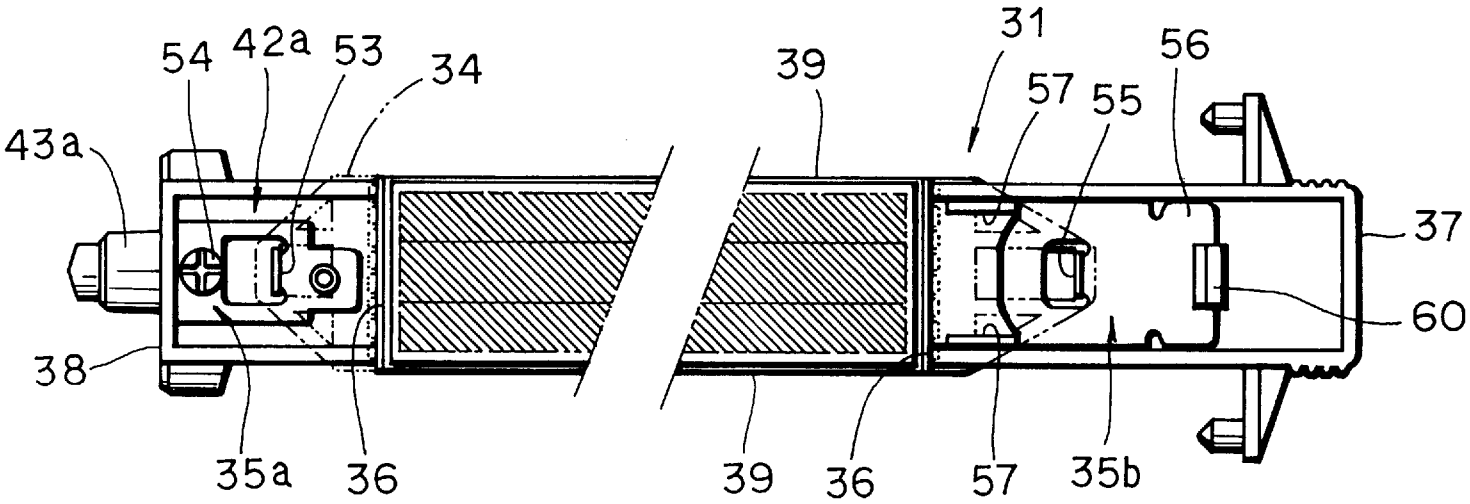
FIGS. 2 and 3 are a plan view and a longitudinal cross sectional view, respectively, of the charging device of the first embodiment.
Figure 3:
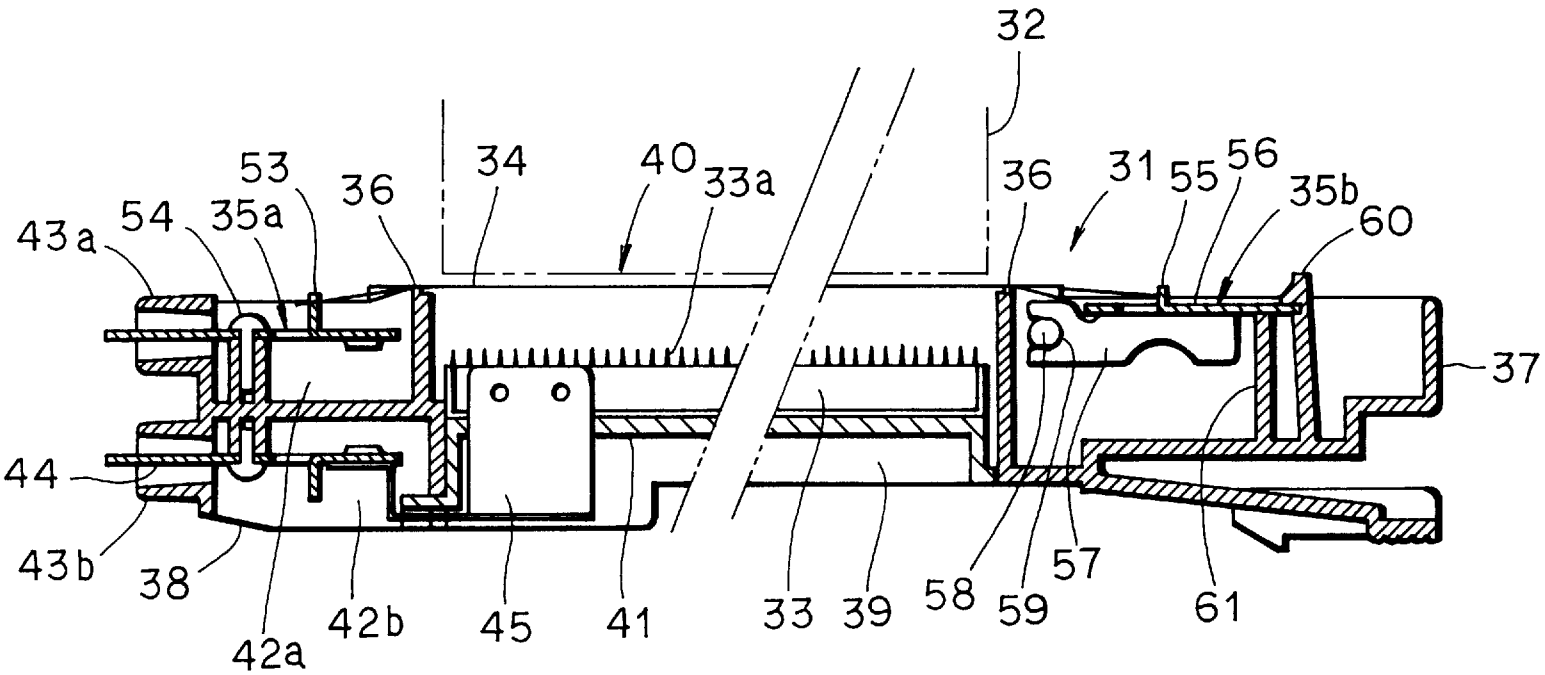

A charging device in accordance with a present embodiment is used as a main charger of a copying apparatus and the like. Referring to FIGS. 2 and 3, the device includes a main body 31 of the charger, a grid plate 34 disposed with a prescribed distance from a surface of a photoreceptor 32 and stabilizing electrostatic charges from a corona discharger 33, a fixed hook 35*a* and a rotatable hook 35*b* serving as a pair of supports for holding grid plate 34 with its both ends pulled in the longitudinal direction, and a regulation member 36 brought into contact with a rear surface of both ends of grid plate 34 for regulating the distance between the plate and the surface of photoreceptor 32.

Main body 31 includes front and rear housings 37 and 38 and a pair of side plates 39 of stainless steel for coupling the housings. Front and rear housings 37 and 38 are disposed with a fixed distance therebetween (slightly longer than the length of the photoreceptor) and the side walls thereof are linked by side plates 39. A rectangular space is formed in the longitudinal direction of photoreceptor 32, surrounded by housings 37 and 38 and side plates 39. Corona discharger 33 is provided in this space, and grid plate 34 is disposed so as to cover an open surface 40 on the side of photoreceptor 32.

Corona discharger 33 is a flat plate of stainless steel having a needle-like discharging portion 33*a*, and is attached to a holding base 41 made of insulating material (for example, insulating resin such as polycarbonate). Corona discharger 33 is disposed in the space in main body 31 so that its discharging portion 33*a* faces photoreceptor 32. Holding base 41 is fixed to front and rear housings 37 and 38.

Front and rear housings 37 and 38 are each formed as a rectangular box of insulating material similarly to holding base 41. In housings 37 and 38, fixed hook 35*a* and rotatable hook 35*b* for holding grid plate 34, which will be described later, are disposed. Rear housing 38 is divided into upper and lower rooms 42*a* and 42*b*, and at the rear wall of the housing upper and lower cylinders 43*a* and 43*b* are provided projecting outward and connecting rooms 42*a* and 42*b* and the outside, respectively. Fixed hook 35*a* is provided in upper room 42*a*, while a plate-like electrode 44 for applying a voltage to corona discharger 33 is fixed in lower room 42*b*. One end of electrode plate 44 is connected to corona discharger 33 through a connection plate 45 and a little part of the other end extends externally from lower cylinder 43*b*.

A voltage is applied to electrode 44 at this portion extending from lower cylinder 43*b*.

Figure 4:
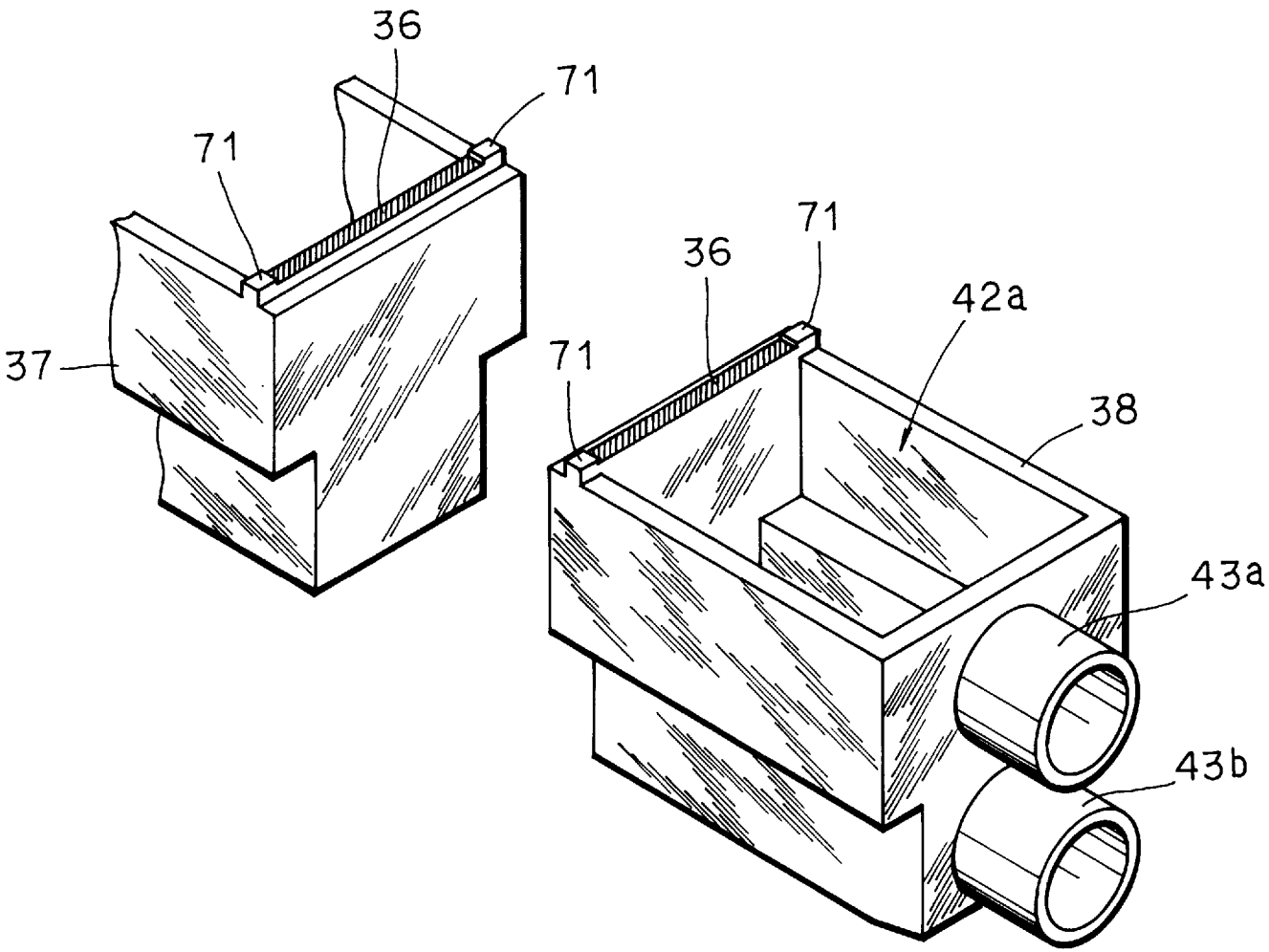
FIG. 4 is an enlarged perspective view of front and rear housings of the first embodiment.

Referring to FIG. 4, each upper surface of the opposing walls of the housings 37 and 38 is stepped with the upper surface on the opposing side being lower. A surface raised from the upper surface of each side wall of housings 37 and 38 serves as regulation member 36 abutting the rear surface of grid plate 34. By bringing grid plate 34 into close contact with regulation member 36, the distance between grid plate 34 and the surface of the photoreceptor is maintained at a predetermined amount (approximately 1 mm at the breadthwise central portion of the grid plate).

Figure 5:
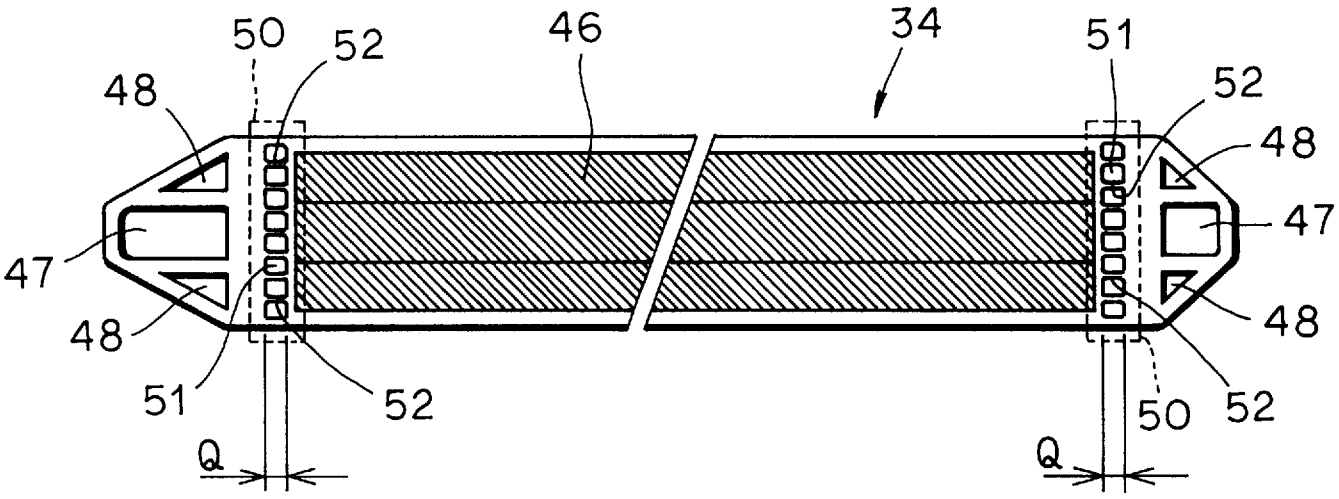
FIG. 5 is a plan view of a grid plate of the first embodiment.

Referring to FIG. 5, grid plate 34 is a thin metal plate formed of stainless steel or other alloys with a thickness of approximately 0.1 mm. It has a mesh structure (the shaded region in the figure) 46 formed by etching except both ends and the breadthwise outer edge portions. Either end of grid plate 34 has a trapezoidal shape with both corners cut out so that its width gradually reduces in the longitudinal direction as it goes away from the center. Each of these ends has a rectangular hole 47 for engaging with the fixed hook 35*a* or the rotatable hook 35*b* and triangular holes 48. Grid plate 34 controls discharge of corona discharger 33 so as to make the surface potential of photoreceptor 32 uniform without any variation in charges. A voltage is applied to grid plate 34 through fixed hook 35*a* which will be described later.

A region of grid plate 34 between mesh structure 46 and hole 47 of each end forms a contact portion 50 abutting regulation member 36. At this contact portion 50, eight openings 51 are provided along its width. Openings 51 are each formed as a rectangle having the same length Q and are arranged in the direction of its width. Each bridge 52 between openings 51 has a width set to be 1.5 mm or less. Openings 51 serve to weaken, only at contact portion 50 with respect to the other portions, the rigidity exerted when grid plate 34 is bent in the longitudinal direction, i.e. the bending strength.

As shown in FIGS. 2 and 3, fixed hook 35*a* and rotatable hook 35*b* are disposed in front and rear housings 37 and 38, respectively, and hold grid plate 34 by hooking both ends thereof. Hook 35*a* is fixed and holds one end of grid plate 34, and hook 35*b* holds the other end of plate 34 and is rotatable so as to pull the plate in the longitudinal direction. Fixed hook 35*a* is formed as a plate of electrically conductive material such as metal and has a projection 53 engaging with hole 47 which is a rectangular cutout at the central portion of grid plate 34. Fixed hook 35*a* is disposed in an upper portion 42*a* of rear housing 38 so that the upper end of projection 53 is lower (separated away from the photoreceptor) than the upper surface of regulation member 36 and that the rear end of hook 35*a* projects outward from upper cylinder 43*a*. Hook 35*a* is fixed by a screw 54. Fixed hook 35*a* also serves as an electrode plate for applying a voltage to grid plate 34. A voltage is applied to the rear end of hook 35*a* projecting from upper cylinder 43*a* of rear housings 38 and is transmitted to grid plate 34.

Rotatable hook 35*b* includes a planer portion 56 on which a projection 55 is formed for engaging with the rectangular cutout hole 47 of grid plate 34 and a leg portion 57 having both breadthwise outer edges bent downward. A supporting axis 58 for rotatablly supporting rotatable hook 35*b* is provided extending between opposing side walls of front housing 37. A U-shaped rotatable engaging portion 59 for rotatablly and detachably engaging with supporting axis 58 of front housing 37 is formed at the rear end of leg portion 57 of rotatable hook 35*b*, and rotatable hook 35*b* is rotated around supporting axis 58.

At front housing 37, a fixing claw 60 is formed as a projection for fixing rotatable hook 35*b* with hook 35*b* hooking grid plate 34 to apply tension thereto. Rotatable hook 35*b* is fixed by fitting the front end thereof to fixing claw 60. Here, the upper surface of rotatable hook 35*b* is in contact with fixing claw 60 and the rear surface thereof is in contact with a stop 61 provided at front housing 37, thereby positioning rotatable hook 35*b*, and projection 55 of hook 35*b* is positioned lower (separated away from the photoreceptor) than the upper surface of regulation member 36. The distance between projections 53 and 55 of hooks 35*a* and 35*b* respectively is set slightly longer (approximately 0.3 mm) than the distance between holes 47 at both ends of the grid plate. Therefore, when rotatable hook 35*b* is rotated and fixed, grid plate 34 is held under tension, pulled in the longitudinal direction. Both end portions of grid plate 34 are held in such a manner that they are bent downward between regulation members 36 of housings 37 and 38 and projections 53 and 55 of hooks 35*a* and 35*b* respectively, so that grid plate 34 is brought in close contact with regulation members 36.

Figure 1:
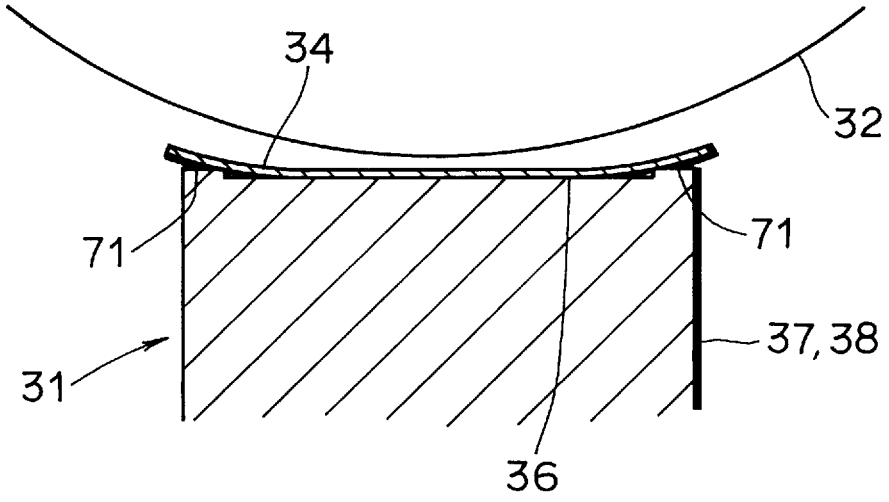
FIG. 1 is a cross sectional view showing an important part of a regulation member of a charging device in accordance with a first embodiment of the present invention.

If grid plate 34 is pulled too strongly, the breadthwise central portion thereof stretches and the outer edge portions are stressed toward the center, whereby grid plate 34 deforms with its central portion elevated toward the photoreceptor and therefore is not brought into close contact with regulation members 36. In order to cope with this problem, elevation suppression means is provided for bringing grid plate 34 into close contact with regulation member 36 when tension is applied to grid plate 34. As shown in FIGS. 1 and 4, this elevation suppression means is formed by a projection 71 formed at each widthwise end of regulation member 36. Projection 71 is made higher to approach photoreceptor 32 than regulation member 36 by approximately 0.5 mm. When grid plate 34 is disposed under tension, the breadthwise outer edge portions of grid plate 34 abut projections 71 and are bent up toward photoreceptor 32, and its breadthwise central portion deforms in the opposite direction toward regulation member 36 and brought into contact with regulation member 36. Although the outer edge portions of plate 34 are bent up toward photoreceptor 32 and are not level with regulation member 36, discharge controllability at the outer edge portions of grid plate 34 is insignificant, and therefore image quality and charged state of photoreceptor 32 will not be adversely affected. In addition, the outer edge portions of grid plate 34 is separated more widely from photoreceptor 32 than its central portion, so that they will not abut photoreceptor 32 and will not be an obstacle.

Figure 6:
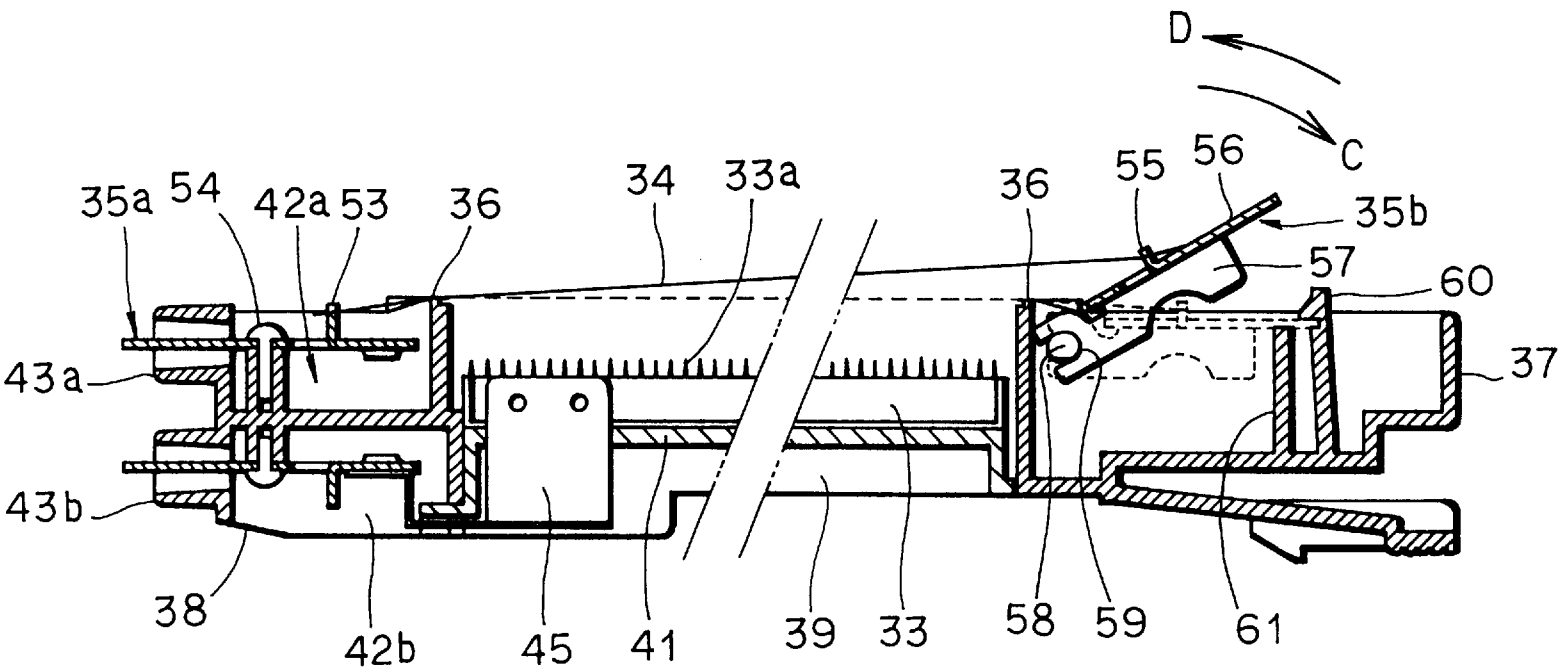
FIG. 6 is a longitudinal cross sectional view of the charging device showing attachment of the grid plate in accordance with the first embodiment.

In the structure above, for attaching grid plate 34 to main body 31 of the charger, hole 47 at one end of plate 34 is hooked to projection 53 of fixed hook 35*a*. Rotatable engaging portion 59 of rotatable hook 35*b* is engaged with supporting axis 58 of front housing 37, and front end of hook 35*b* is positioned above main body 31 as shown in FIG. 6. Next, hole 47 at the other end of the plate 34 is hooked to projection 55 of hook 35*b*.

Thereafter, when rotatable hook 35*b* is rotated outward in the longitudinal direction shown by an arrow C in FIG. 6, tension is gradually applied to grid plate 34 in the longitudinal direction as it rotates and hook 35*b* abuts the slanted surface of fixing claw 60. If rotatable hook 35*b* is stopped from rotating under this state, it is urged to turn back inward in the direction shown by an arrow D by the reaction force of the tension applied to grid plate 34. Therefore, force pressing down hook 35*b* is applied thereto for rotation. As a result, the front end of hook 35*b* rotates downward while pressing the slanted surface of claw 60 outward in the longitudinal direction, whereby claw 60 resiliently deforms outward in the longitudinal direction. When the front end of hook 35*b* has passed over the slanted surface of claw 60, claw 60 stops resilient deformation and goes back to the original position. The rear surface of hook 35*b* abuts stop 61 and claw 60 fixes hook 35*b* by abutting the upper surface thereof and prevents elevation thereof.

At this time, constant tension is applied to grid plate 34, and the bending strength in the longitudinal direction of grid plate 34 is weakened by openings 51 of contact portion 50. The plate 34 is held in such a manner that its portions between projections 53 and 55 of hooks 35*a* and 35*b* and regulation members 36 of housings 37 and 38 respectively are deflected and contact portion 50 of grid plate 34 is brought into close contact with regulation member 36. As shown in FIG. 1, the breadthwise outer edge portions are forced to bend up toward photoreceptor 32 by projections 71 provided at regulation members 36. The breadthwise central portion of plate 34 deforms in the opposite direction toward regulation member 36 and is brought into contact therewith and kept level with regulation member 36.

For detaching grid plate 34, fixing claw 60 is pressed outward in the longitudinal direction so that it deforms resiliently, and rotatable hook 35*b* is disengaged from claw 60. By the tension applied to grid plate 34, rotatable hook 35*b* is rotated inward in the longitudinal direction and the tension is released, so that grid plate 34 can be detached.

As described above, by providing projection 71 at regulation member 36, the breadthwise outer edge portion of grid plate 34 is forced to bend up toward photoreceptor 32 when tension is applied to grid plate 34, whereby the breadthwise central portion of plate 34 deforms in the opposite direction toward the regulation member 36 and is brought into contact therewith. Consequently, the breadthwise central portion of the grid plate is not irregularly elevated toward the photoreceptor as in the conventional device, and the breadthwise central portion is kept flat to be level with regulation member 36. As a result, grid plate 34 will not dangerously contact photoreceptor 32, preventing problems of leakage and the like.

Furthermore, projection 71 of regulation member 36 is as low as 0.5 mm in height, more than 60% of the width of plate 34 is level with regulation member 36 at the central portion and less than 20% thereof is bent upward at each outer edge. Consequently, grid plate 34 is kept flat and does not adversely affect discharge controllability of plate 34, thereby ensuring control of the amount of current flowing to photoreceptor 32 and control of the surface potential and preventing degradation in charging performance of the charging device.

Since a plurality of openings 51 are provided at contact portion 50 of grid plate 34 abutting regulation member 36 so as to weaken the bending strength in the longitudinal direction at the portion, contact portion 50 closely contacts regulation member 36 even when it is deflected by the tension applied to grid plate 34, thereby eliminating elevation of grid plate 34 in the longitudinal direction. As a result, discharge controllability of grid plate 34 will not be adversely affected and photoreceptor 32 can be efficiently charged.

Since the above-mentioned other support is provided as rotatable hook 35*b*, grid plate 34 is pulled and detached by simple operations of hooking, rotating, and fixing grid plate 34, and constant tension can be surely applied to grid plate 34. In addition, the structure is simplified because it does not require springs or screws as conventional devices and tension to grid plate 34 need not be adjusted, whereby service operations such as replacement of grid plates are facilitated and time required for replacement is reduced, leading to an improvement in customer service. A reduction in cost can be achieved thanks to the reduced number of parts. Since no part is projecting toward photoreceptor 32 in the proximity thereof, no such part dangerously contacts photoreceptor 32, thereby improving safety of the device.

Second Embodiment

Figure 7:
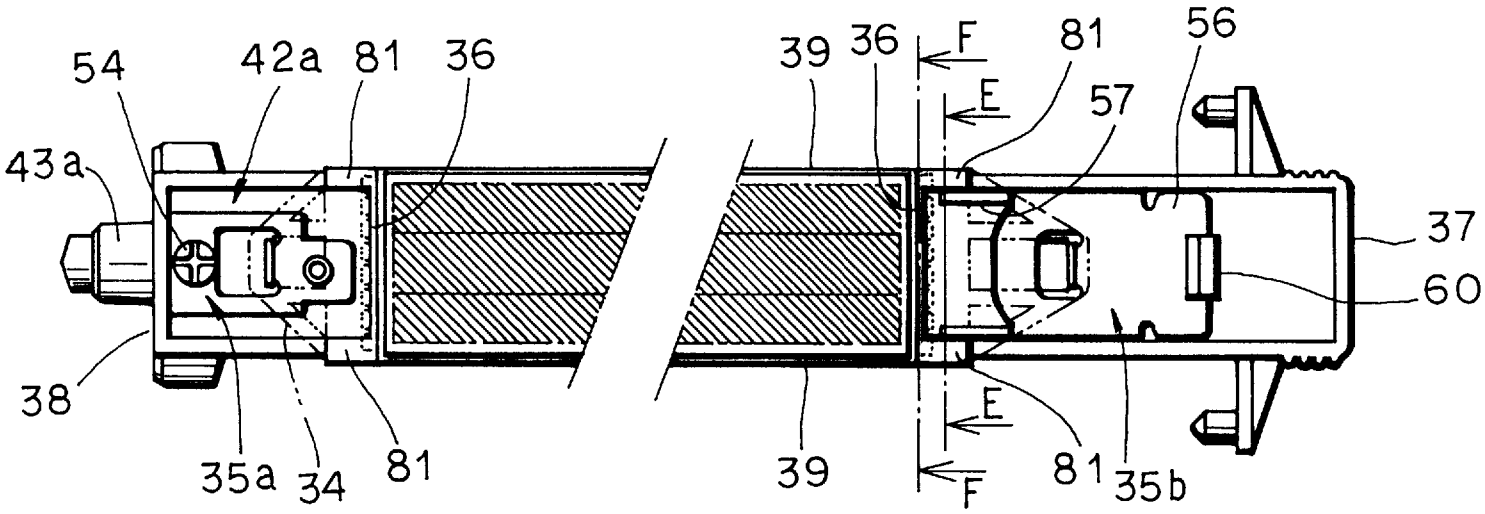
FIG. 7 is a plan view of a charging device in accordance with a second embodiment.
Figure 8:
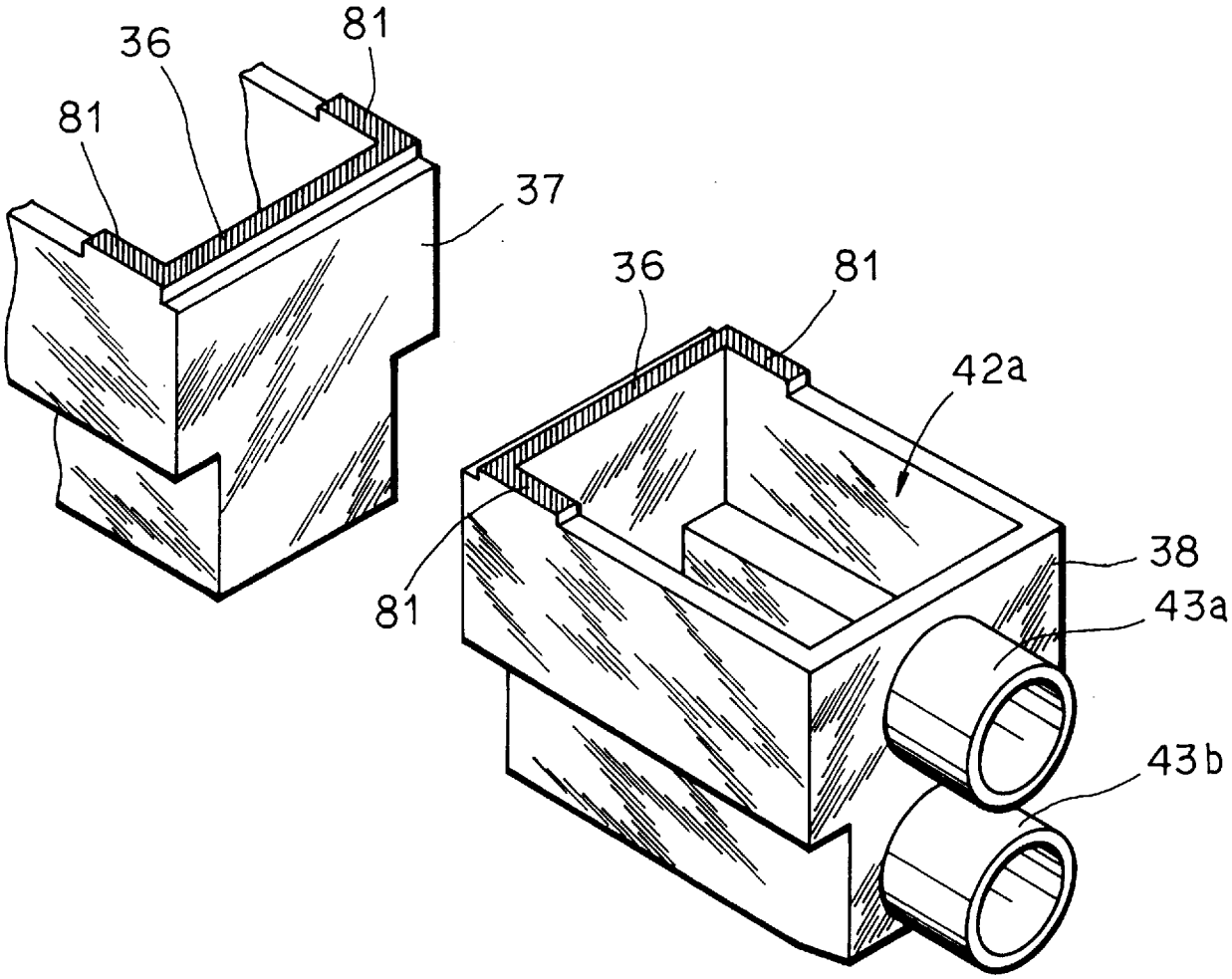
FIG. 8 is an enlarged perspective view of front and rear housings of the second embodiment.

In a charging device of the present embodiment, elevation suppression means is formed by an auxiliary regulation member 81 extending outward in the longitudinal direction from both breadthwise ends of regulation member 36, as shown in FIGS. 7 and 8. Auxiliary regulation member 81 is formed as a part of the upper surface of both side walls of front and rear housings 37 and 38, raised from the other portions to be level with regulation member 36, having a U-shaped surface and connected to regulation member 36. The rest of the structure is the same as that of the first embodiment.

Figure 9:
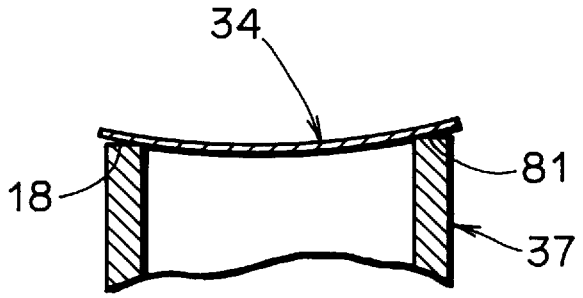
FIGS. 9 and 10 are enlarged cross sectional views taken along the lines E—E and F—F in FIG. 7, respectively.
Figure 10:
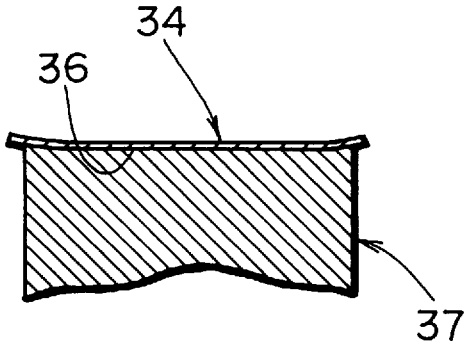

When tension is applied to grid plate 34 by auxiliary regulation member 81, at a region of grid plate 34 between contact portion 50 and hole 47 the breadthwise outer edges are forced to bend upward and the central portion is bent downward away from photoreceptor 32, as shown in FIG. 9. Referring to FIG. 10, contact portion 50 of plate 34 becomes ideally flat to contact regulation member 36. Consequently, the breadthwise central portion of the grid plate 34 is not elevated toward photoreceptor 32 and plate 34 is kept completely flat at an effective discharge region for photoreceptor 32, so that discharge controllability of grid plate 34 is not adversely affected.

Figure 11:
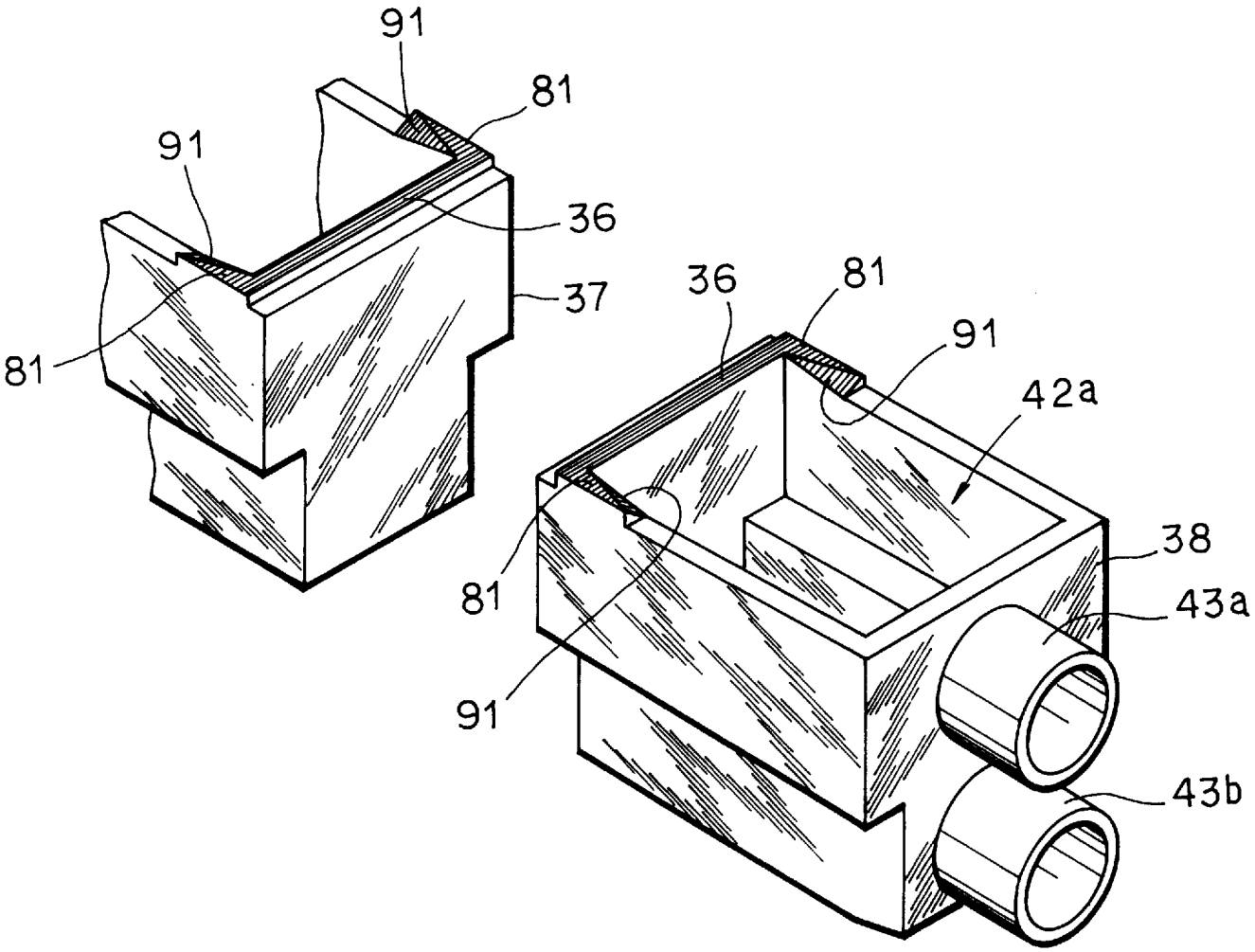
FIG. 11 is an enlarged perspective view of front and rear housings in accordance with another embodiment of the present invention.
Figure 12:
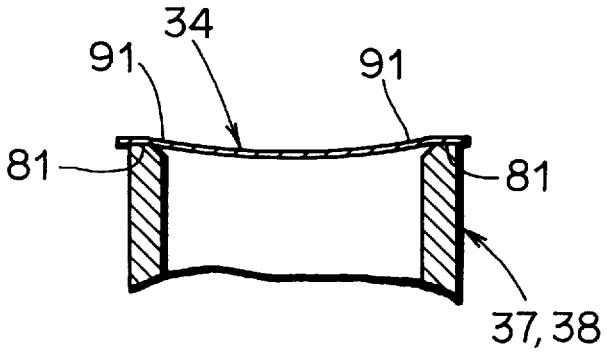
FIG. 12 shows a state of a grid plate between the auxiliary regulation members.
Figure 13:
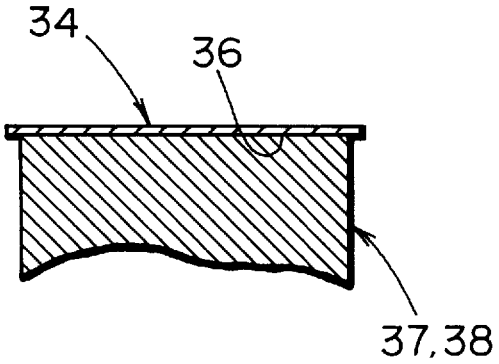
FIG. 13 shows a state of the grid plate on the auxiliary regulation member.

In the charging device of the present embodiment, the breadthwise outer edge portions of plate 34 are bent upward by auxiliary regulation members 81. Although this causes no problems in terms of functions of plate 34 such as discharge controllability at an inner corner of auxiliary regulation member 81 a chamfered portion 91 is provided which is tapered with its width gradually increased outward in the longitudinal direction as shown in FIG. 11, so as to suppress generation of unnecessary stress at the widthwise outer edge portion of grid plate 34. Thus, the outer edge portions of plate 34 are suppressed from bending upward by auxiliary regulation member 81 as shown in FIG. 12, and grid plate 34 is kept flat bearing against regulation member 36 as shown in FIG. 13. More specifically, when plate 34 is under tension, the outer edge portion of plate 34 is supported by the tapered chamfer 91 of auxiliary regulation member 81 between each regulation member 36 of housings 37 and 38 and the corresponding one of projections 53 and 55 of hooks 35*a* and 35*b*. Chamfer 91 has a width gradually increased outward in the longitudinal direction so as not to keep plate 34 flat and naturally helps the plate bend away from photoreceptor 32, that is, to promote resilient deformation, thereby substantially eliminating upward deflection of the outer edge portion of plate 34.

The present invention is not limited to the above-described embodiments and many modifications and changes can be made to the embodiments above within the scope of the invention.

For example, although a main charger in a copying apparatus has been described above, the present invention can be applied to such discharging devices as transfer chargers or other corona dischargers.

Figure 14:
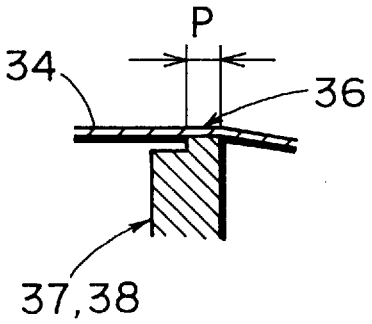
FIG. 14 is an enlarged cross sectional view of a regulation member in accordance with still another embodiment.
Figure 15:
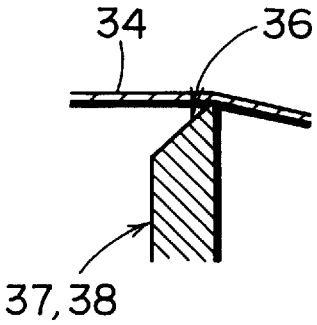
FIG. 15 is an enlarged cross sectional view of the regulation member in accordance with a further embodiment.
Figure 16:
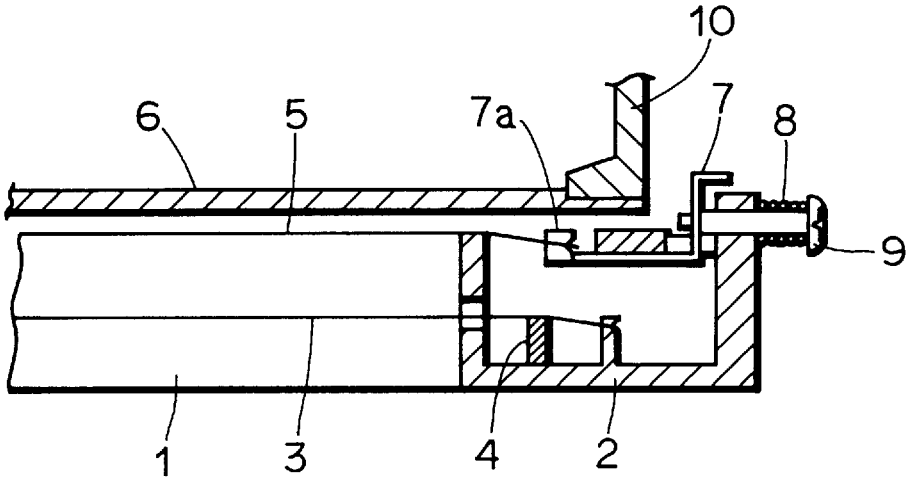
FIG. 16 PRIOR ART
FIG. 16 is a cross sectional view showing a conventional charging device.
Figure 17:
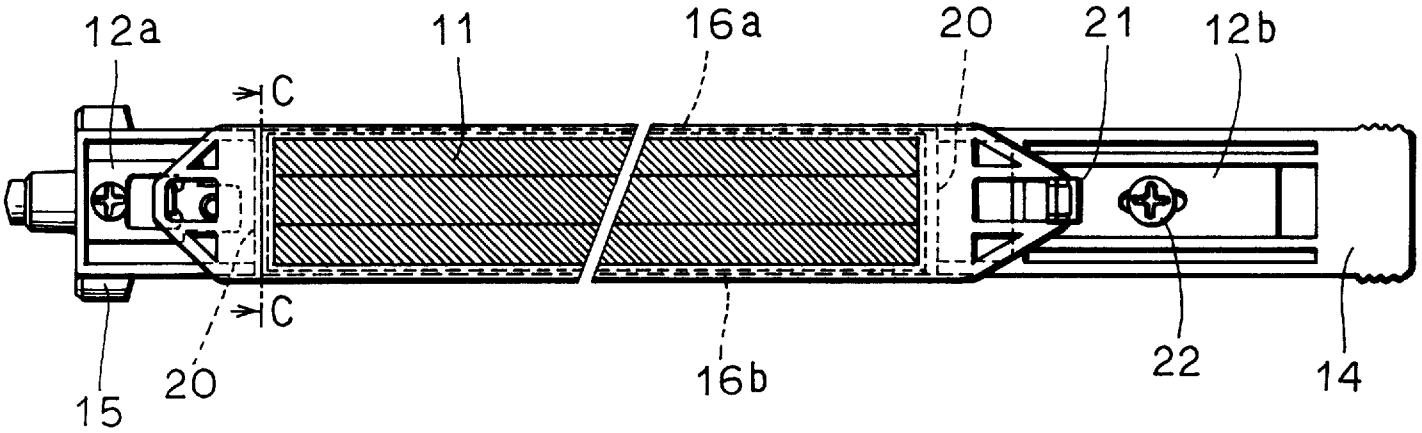
FIG. 17 PRIOR ART
FIGS. 17–19 are a plan view, a longitudinal cross sectional view, and an exploded perspective view, respectively, of another conventional charging device.
Figure 18:
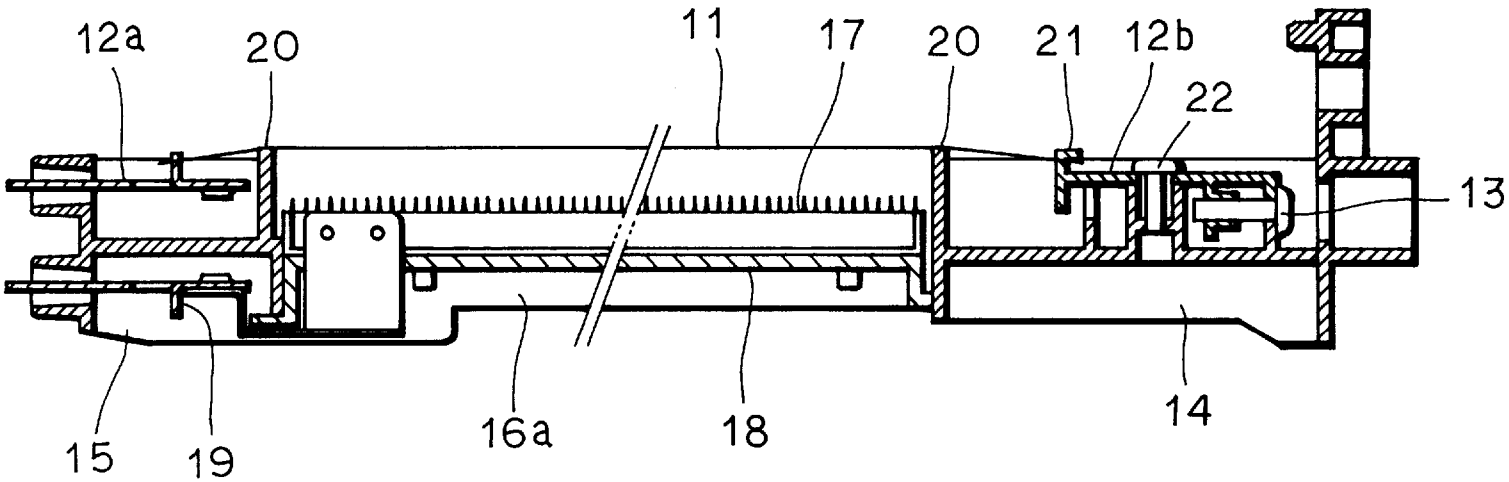
FIG. 18 PRIOR ART
Figure 19:
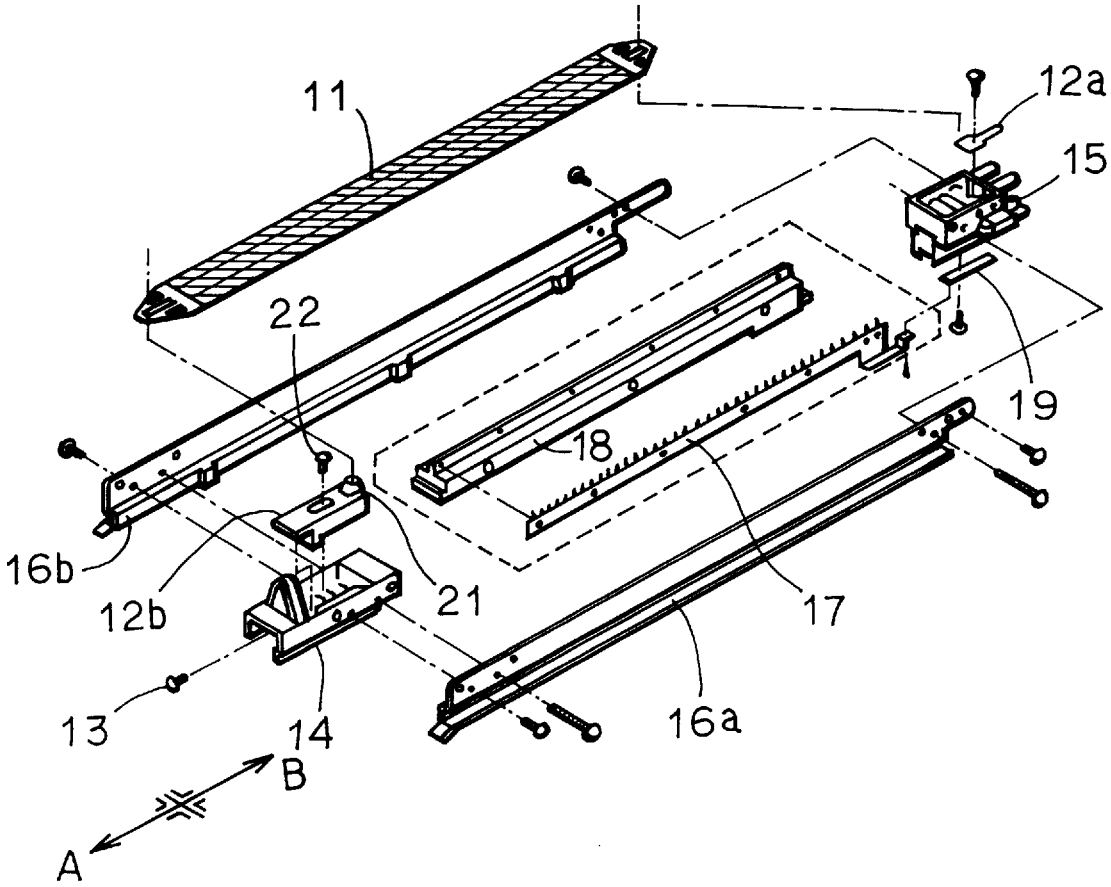
FIG.19 PRIOR ART
Figure 20:
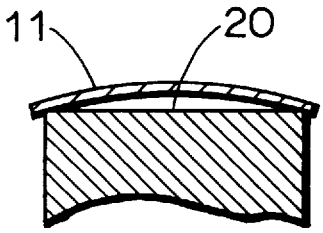
FIG.20 PRIOR ART
FIG. 20 is an enlarged cross sectional view taken along the line C—C in FIG. 17.
Figure 21:
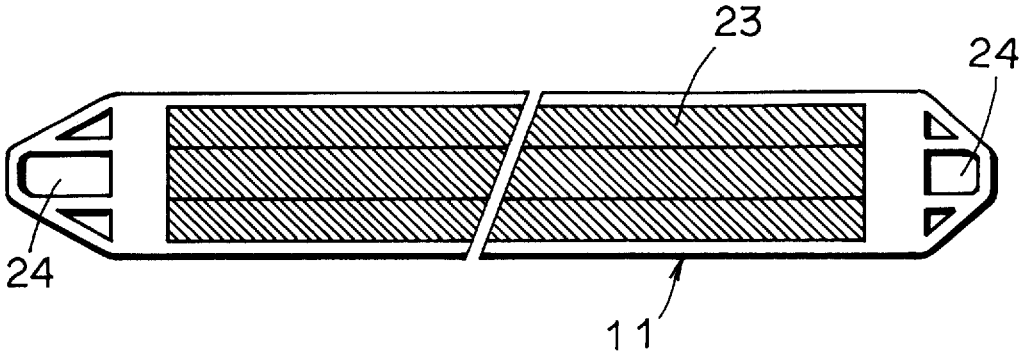
FIG.21 PRIOR ART
FIG. 21 is a plan view of a grid plate.
Figure 22:
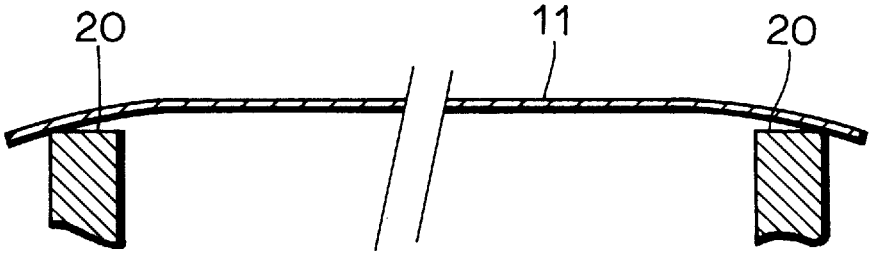
FIG.22 PRIOR ART
FIG. 22 shows a bent grid plate.

The length of regulation member 36 in the longitudinal direction abutting grid plate 34 has not been specified in the above-described embodiments. However, referring to FIG. 14, a length P of regulation member 36 can be set as $P<Q$ with respect to length Q of opening 51 of grid plate 34, or regulation member 36 can have a sharp bevelled upper surface, so that stress at regulation member 36 caused by slight deflection of grid plate 34 in the longitudinal direction can be concentrated even further. More specifically, the slight deflection of grid plate 34 can be concentrated on bridges 52 between openings 51 of grid plate 34, thereby suppressing elevation of grid plate 34 in the longitudinal direction even more efficiently.

Although fixed hook 35*a* for holding grid plate 34 is fixed by screw 54 to the rear housing 38, it can be provided movably in the longitudinal direction. More specifically, a hole for the screw to fix hook 35*a* can be made as an oval hole so that hook 35*a* can move in the range of the oval hole by loosing screw 54 in order to achieve fine adjustment of tension to grid plate 34.

As apparent from the description above, in the charging device in accordance with one aspect of the present invention, the elevation suppression means (projection) is provided at the regulation member, so that the breadthwise outer edge portions of the grid plate are forced to bend up toward the photoreceptor when tension is applied to the grid plate and the breadthwise central portion of the plate deforms in the opposite direction toward the regulation member and is brought into close contact with the regulation member. Therefore, the central portion of the plate is not irregularly elevated toward the photoreceptor and kept flat to be level with the regulation member, and the distance between the grid plate and the photoreceptor is kept constant. As a result, the grid plate will not dangerously touch the photoreceptor and no leakage will occur.

In addition, the breadthwise central portion of the plate is brought into close contact with the regulation member, so that the plate is kept flat and no adverse effect is given on the discharge controllability of the plate. Consequently, control of the amount of current flowing to the photoreceptor and control of surface potential can further be ensured and the charging performance of a charging device will not decline.

Preferably, the auxiliary regulation member is provided extending from the regulation member, so that the breadthwise outer edge portions of the grid plate are forced to bend upward between the support and the regulation member when tension is applied to the plate and the central portion of the plate therebetween deflects away from the photoreceptor, and the grid plate becomes ideally flat to closely contact the regulation member. As a result, the central portion of the plate is not elevated toward the photoreceptor and plate is held completely flat at the effective discharging region for the photoreceptor, giving no adverse effects on the discharge controllability of the plate.

Preferably, a plurality of openings are provided at the contact portion of the grid plate abutting the regulation member so as to weaken the lengthwise bending strength at the contact portion. As a result, the contact portion is brought into close contact with the regulation member even when it is bent by the tension applied to the grid plate, thereby eliminating elevation of the plate in the longitudinal direction. Therefore, the discharge control ability of the plate is not adversely affected and the photoreceptor is efficiently charged.

The other support is preferably rotatable, so that the grid plate can be attached or detached when tension is not applied thereto and the plate can be held under tension by rotating the support. Thus, by such a simple operation as rotation of the support, the grid plate can be easily attached and detached and can surely receive constant tension. In addition, no springs or screws are necessary as in the conventional device, simplifying the structure of the device and eliminating the need to adjust tension of the grid plate. Consequently, service operations such as replacement of grid plates are facilitated considerably, leading to a reduction in time for replacement and to an improvement in customer service. Since the number of parts required in the device is reduced, reduction in cost can be achieved. Furthermore, since there is no part projecting toward the photoreceptor in the proximity thereof, the device will not dangerously touch the photoreceptor, enhancing security of the device.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A charging device, comprising:

a grid plate disposed with a prescribed distance from a surface of a photoreceptor for stabilizing electrostatic charges from a corona discharger;

a support for holding said grid plate with its opposing ends pulled in longitudinal direction;

a regulation member abutting a rear surface of the opposing ends of said grid plate for regulating the distance between said grid plate and said surface of the photoreceptor; and elevation suppression means for suppressing elevation of a central portion of the grid plate and bringing said central portion of the grid plate into close contact with said regulation member when tension is applied to said grid plate.

2. The charging device according to claim 1, wherein said elevation suppression means is a projection formed at breadthwise opposing ends of said regulation member.

3. The charging device according to claim 1, wherein said elevation suppression means is an auxiliary regulation member formed to extend outward in the longitudinal direction from the breadthwise opposing ends of said regulation member.

4. The charging device according to claim 3, wherein each upper end portion of opposing inner side surfaces of said auxiliary regulation member is tapered.

5. The charging device according to claim 4, wherein a distance between the tapered upper end portions of the opposing inner side surfaces of said auxiliary regulation member gradually increases in the longitudinal direction of said grid plate.

6. The charging device according to claim 4, wherein said tapered upper end portion of the inner side surface is formed like a blade.

7. The charging device according to claim 1, wherein a plurality of openings are provided breadthwise along said grid plate at a contact portion which is located at each end of said grid plate and abuts the regulation members.

8. The charging device according to claim 1, wherein said support includes a first support fixing and holding one end of said grid plate, and a second support being rotatable for holding and pulling in the longitudinal direction the other end of said grid plate.

9. The charging device according to claim 8, wherein said first support is fixed movable in the longitudinal direction of said grid plate.

10. A charging device, comprising:

a grid plate disposed with a prescribed distance from a surface of a photoreceptor for stabilizing electrostatic charges from a corona discharger;

a support for holding said grid plate with its opposing ends pulled in longitudinal direction;

a regulation member abutting a rear surface of the opposing ends of said grid plate for regulating the distance between said grid plate and said surface of the photoreceptor; and elevation suppression means for bringing said grid plate into close contact with said regulation member when tension is applied to said grid plate, so that a central portion of the grid plate does not elevate toward the surface of the photoreceptor.

11. A charging device, comprising:

a grid plate disposed with a prescribed distance from a surface of a photoreceptor for stabilizing electrostatic charges from a corona discharger;

a support for holding said grid plate with its opposing ends pulled in longitudinal direction;

a regulation member abutting a rear surface of the opposing ends of said grid plate for regulating the distance between said grid plate and said surface of the photoreceptor; and an elevation suppression device for bringing said grid plate into close contact with said regulation member when tension is applied to said grid plate, so that a central portion of the grid plate does not elevate toward the surface of the photoreceptor.

* * * * *